United States Patent [19]

Salice

[11] Patent Number: 4,509,229

[45] Date of Patent: Apr. 9, 1985

[54] CONCEALED HINGE HAVING A SPRING BIASED U-SHAPED SLIDER

[75] Inventor: Luciano Salice, Carimate, Italy

[73] Assignee: Arturo Salice, S.p.A., Novedrate, Italy

[21] Appl. No.: 585,447

[22] Filed: Mar. 2, 1984

[30] Foreign Application Priority Data

Mar. 4, 1983 [DE] Fed. Rep. of Germany ..... 3307777

[51] Int. Cl.[3] ..... E05D 11/10

[52] U.S. Cl. ..... 16/327; 16/379

[58] Field of Search ..... 16/291, 293, 321, 325, 16/326, 327, 352, 378, 379

[56] References Cited

U.S. PATENT DOCUMENTS

| | | | |
|---|---|---|---|
| 3,908,226 | 9/1975 | Read et al. | 16/DIG. 40 |
| 4,210,979 | 7/1980 | Boyd | 16/327 |
| 4,240,179 | 12/1980 | Lautenschlager, Jr. | 16/321 |

*Primary Examiner*—Fred A. Silverberg

*Attorney, Agent, or Firm*—Morgan, Finnegan, Pine, Foley & Lee

[57] ABSTRACT

A concealed hinge assembly for use with doors, hinged plates or the like comprises a mounting plate and a projecting base member connected to the mounting plate. A hinge bracket is screw-connected to said base member adjacent to one end of said hinge bracket and at its other end is so connected to one side of a pot-shaped member that the one end of the hinge bracket enters the pot-shaped member during the closing movement. A slider which is biased by two parallel coiled compression springs is guided in the pot-shaped member in a radial plane and carries a cam, which during the closing movement cooperates with a projection or the like carried by the hinge bracket. To ensure that the cam will engage the hinge bracket with a relatively large lever arm during the final phase of the closing movement, the slider is U-shaped and comprises a crosspiece and side legs, which are guided in mating recesses of the pot-shaped member and at their free ends are provided with inwardly extending angled portions or projections, which are engaged by the compression springs at one end thereof whereas the compression springs bear at their other end on abutments consisting of stops carried by the pot-shaped member. The crosspiece carries the cam. One end portion of the hinge bracket extends beyond the projecting base member and runs up and slides on the cam during the closing movement.

4 Claims, 8 Drawing Figures

Fig. 1
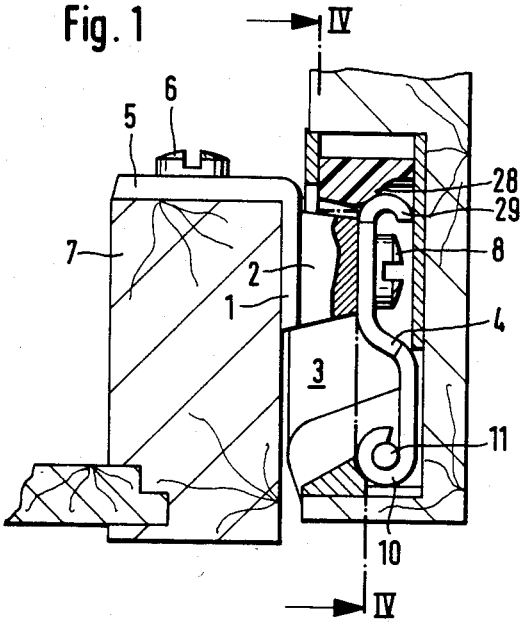
Fig. 3
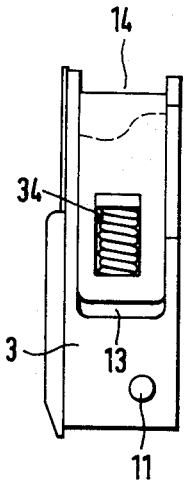
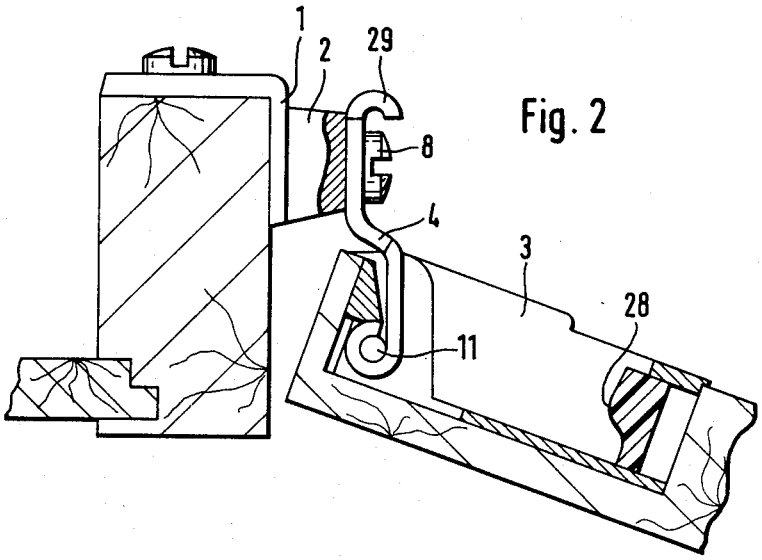
Fig. 2

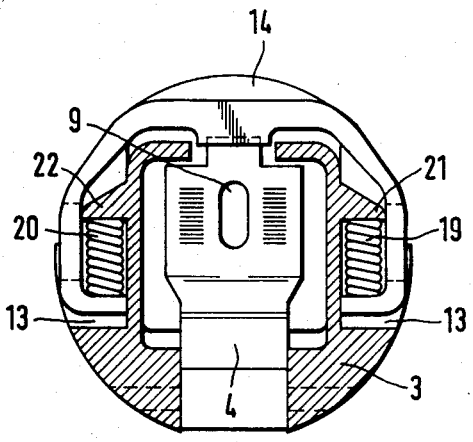
Fig. 4
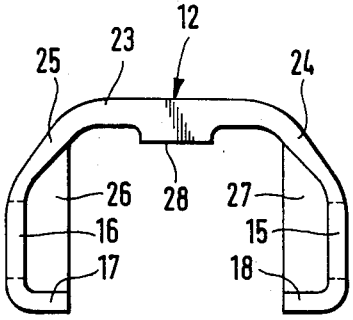
Fig. 5
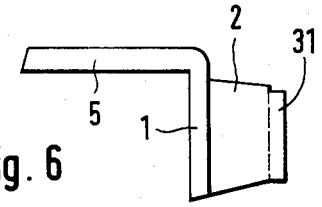
Fig. 6
Fig. 8
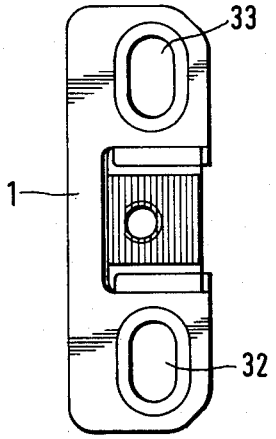
Fig. 7
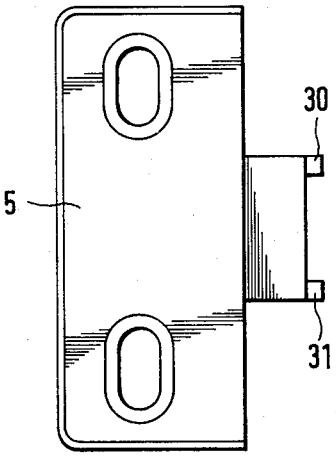

CONCEALED HINGE HAVING A SPRING BIASED U-SHAPED SLIDER

This invention relates to a concealed hinge assembly for use with doors, hinged plates or the like, comprising a mounting plate, a projecting base member, which is connected to the mounting plate, a hinge bracket, which adjacent to its one end is screw-connected to the mounting plate and at its other end is hinged to one side of a pot-shaped member in such a manner that the hinge bracket moves into the pot-shaped member during the closing movement, and a slider which is guided in the pot-shaped member in a radial plane and biased by two mutually parallel coiled compression springs and carries a cam, which during the closing movement cooperates with a projection or the like of the hinge bracket.

In a known hinge assembly of that kind the slider is platelike and has an angled portion, the adjacent end portion of the hinge bracket is curled to form a bearing eye and the angled portion of the slider bears on said end portion in such a manner that during the final phase of the closing movement the angled portion slides over the terminal edge of the curled end portion so that the hinge assembly tends to hold itself closed.

In another concealed hinge assembly having a single pivot, a forked controlling member straddles the hinge bracket, which is secured to a base member mounted on the mounting plate, said controlling member is pivoted in the pot-shaped member and biased by two coil springs, and curled tongues provided on the sides of the hinge bracket run up on and slide along cams carried by the prongs of the forked member during the final phase of the closing movement.

In the known hinge assemblies the springs which apply a closing force to the cam must be relatively strong if an adequate closing force is to be exerted because the closing forces are exerted with only a short lever arm on the hinge bracket at an intermediate portion thereof or adjacent to the hinge.

For this reason it is an object of the invention to provide a hinge assembly which is of the kind described first hereinbefore and is simple in structure and in which the cam engages the hinge bracket with a relatively large lever arm during the final phase of the closing movement.

This object is accomplished in accordance with the invention in that the slider is U-shaped and comprises a crosspiece and side legs, which are guided in mating recesses of the pot-shaped member and at their free ends are provided with inwardly directed, angled portions or projections, the compression springs bear at one end on said angled portions or projections and at the other end on abutments consisting of stops carried by the pot-shaped member, the crosspiece carries the cam, and the hinge bracket has an end portion which extends beyond the projecting base member and runs up and slides along said cam. In that arrangement that end of the hinge bracket which is opposite to the hinge cooperates with the spring-loaded cam so that the extended hinge bracket becomes effective throughout its length during the final phase of the closing movement and stronger closing forces can be exerted even when the spring forces are relatively small. For this reason the friction forces and the wear can be reduced.

Desirable further features of the invention will be recited in the dependent claims.

An illustrative embodiment of the invention will now be explained more fully with reference to the drawing, in which FIG. 1 is a side elevation, partly in section, showing a first embodiment of a hinge assembly in its closed position, FIG. 2 shows the hinge assembly of FIG. 1 in an open position.

FIG. 3 is a side elevation showing the pot-shaped member of the hinge assembly of FIGS. 1 and 2, FIG. 4 is a sectional view taken on line IV—IV in FIG. 1, FIG. 5 is a top plan view showing the slider provided with the cam, FIG. 6 is a side elevation showing the mounting plate of the hinge assembly of FIG. 1, FIG. 7 is a top plan view showing the mounting plate of FIG. 6 and FIG. 8 is a top plan view showing a second embodiment of the mounting plate of a hinge assembly.

The hinge assembly shown in the drawing comprises a mounting plate 1, a protruding base member 2 carried by said mounting plate 1, and a pot-shaped member 3, which is pivoted to a hinge bracket 4 that is secured to the base member 2. In the embodiment shown in FIGS. 1 to 7 the mounting plate 1 is angled and comprises a flange 5, which is connected by screws 6 to the inner end edges of a furniture frame 7 or the like.

The hinge bracket is Z-shaped as shown and is secured by a screw 8 to that end face of the protruding base member 2 which is parallel to the mounting plate 1. The hinge bracket 4 has a slot 9 so that it is laterally adjustable. The free end portion of the hinge bracket 4 is curled to form a bearing eye 10, which is pivoted on a hinge pin 11, which is held in side portions of the pot-shaped member 3. The hinge pin 11 is disposed near the outer rim of the pot-shaped member 3, as shown.

A U-shaped slider 12 is mounted in the pot-shaped member 3 and slidable parallel to itself in a radial plane. For guiding the U-shaped slider 12, the pot-shaped member 3 is formed with recesses 13, 14 having parallel boundary faces. The U-shaped slider is provided at the free ends of its legs 15, 16 with inwardly angled portions 17, 18, which constitute abutments for one end of respective coiled compression springs 19, 20, which at their other end bear on abutments 21, 22, which are rigid with the pot-shaped member 3.

The U-shaped member 12 is stiffened by web portions 26, 27, which are provided adjacent to the legs 15, 16 and to transitional portions 24, 25 connecting said legs to the crosspiece 23. The crosspiece 23 carries a centrally disposed, inwardly facing cam 28. The hinge bracket 4 has a semicircularly curved end portion 29, which extends beyond the base member 2 and runs up on the cam 28 during the closing movement. The configuration of the cam 28 is selected in dependence on the characteristic which is desired for the hinge in the final phase of its closing movement. In the embodiment shown in FIG. 1 that portion of the cam 28 which is engaged first by the end portion 29 during the closing movement is beveled toward the center of the pot-shaped member. That portion of the cam which is engaged by the end portion during the final phase of the closing movement tapers outwardly in arcuate shape so that the hinge assembly will be resiliently held in its closed position by an adequate force.

To ensure that the hinge bracket 4 will be reliably secured to the projecting base portion 2, the latter has a corrugated end face facing the hinge bracket 4. That end face is also provided with lateral ribs 30, 31 for guiding the hinge bracket 4 so that an undesired pivotal movement of the hinge bracket will be prevented.

The hinge bracket 4 may also be provided with corrugated portions on both sides of the slot 9.

In the embodiment shown in FIG. 8 the mounting plate 1 is also provided with fixing holes consisting of slots 32, 33 and is not provided with a fixing flange.

To facilitate the insertion of the compression springs 19, 20, the legs 15, 16 of the U-shaped slider are formed with approximately rectangular windows 34. The slider 12 is suitably made of plastic material so that the friction between the slider and the hinge bracket 4, which consists of a bent metal strip, is reduced.

What is claimed is:

1. A concealed hinge assembly, comprising a mounting plate, a projecting base member, which is connected to the mounting plate, a hinge bracket, which adjacent to its one end is screw-connected to the mounting plate and at its other end is hinged to one side of a pot-shaped member in such a manner that the one end on the hinge bracket moves into the pot-shaped member during closing movement, and a slider, which is guided in the pot-shaped member in a radial plane and biased by two mutually parallel coiled compression springs and carries a cam, which during the closing movement cooperates with a projection of the hinge bracket, characterized in that the slider is U-shaped and comprises a crosspiece and side legs, which are guided in mating recesses of the pot-shaped member and at their free ends are provided with inwardly directed, angled projections, the compression springs bear at one end on said angled projections and at the other end on abutments consisting of stops carried by the pot-shaped member, the crosspiece carries the cam, and the hinge bracket has an end portion which extends beyond the projecting base member and runs up and slides along said cam.

2. A hinge assembly according to claim 1, characterized in that the end portion of the hinge bracket which is slidable on the cam is arcuate or curled.

3. A hinge assembly according to claim 1, characterized in that the legs of the slider comprise stiffening bars extending between the angled projections and transitional portions provided between the legs and the crosspiece.

4. A hinge assembly according to claim 1, characterized in that the hinge bracket is guided on the base member by guide ribs provided on opposite sides of the hinge bracket.

* * * * *